US005254037A

United States Patent [19]

Penniman

[11] Patent Number: 5,254,037

[45] Date of Patent: Oct. 19, 1993

[54] PORTABLE WRITING APPARATUS

[75] Inventor: Scott R. Penniman, Spring House, Pa.

[73] Assignee: R.E.P. Industries, Inc., Lansdale, Pa.

[21] Appl. No.: 863,614

[22] Filed: Apr. 6, 1992

[51] Int. Cl.[5] ..... B41L 3/04

[52] U.S. Cl. ..... 462/79; 462/80

[58] Field of Search ..... 462/78, 79, 80, 81, 462/82

[56] References Cited

U.S. PATENT DOCUMENTS

| | | | |
|---|---|---|---|
| 2,696,393 | 12/1954 | Fitzgerald | 462/79 |
| 3,332,707 | 7/1967 | Bell, Jr. | 462/79 |
| 4,429,901 | 2/1984 | Clery, Jr. et al. | 462/77 |
| 4,591,188 | 5/1986 | Hensel et al. | 462/79 |
| 4,687,229 | 8/1987 | Penniman | 462/78 |

FOREIGN PATENT DOCUMENTS

| | | | |
|---|---|---|---|
| 248379 | 2/1948 | Switzerland | 462/79 |

*Primary Examiner*—Paul A. Bell

*Attorney, Agent, or Firm*—Seidel, Gonda, Lavorgna & Monaco

[57] ABSTRACT

A portable writing apparatus is provided which includes a substantially flat writing surface and a plurality of posts which are adjacent to one edge of the writing surface and extending outwardly therefrom. At least one of the posts is formed with a recess therein. A latch cover is provided to lay over the plurality of posts. The latch cover has a plurality of openings therein which are designed to receive the plurality of posts when the latch cover is laid thereover. A latch is integral with the latch cover and is associated with at least one of the latch cover's openings. This latch releasably attaches the latch cover to the post having a recess therein.

11 Claims, 3 Drawing Sheets

PORTABLE WRITING APPARATUS

FIELD OF THE INVENTION

The present invention relates to a portable writing apparatus for so-called "one write" accounting systems.

BACKGROUND OF THE INVENTION

In accounting and bookkeeping systems, it is frequently desired to write and post checks and other transactions. In accounting and bookkeeping usage, "posting" refers broadly to the transfer of information regarding individual transactions, such as individual checks, onto a ledger. The present invention finds particular utility in transferring information from checks onto a check ledger, but it will be understood by persons familiar with accounting and bookkeeping transactions that the present invention may be used with a variety of bookkeeping and accounting forms.

While the terms "check" and "ledger" may be used herein for ease of description, it should be understood that the invention covers all transactions wherein information regarding an individual transaction is transferred to the appropriate lines and columns of an underlying ledger or summary sheet.

It is known in the art to provide writing apparatus, often called "posting boards," wherein checks or other individual transaction forms are aligned on top of a ledger or summary form, with pressure-sensitive duplicating material therebetween. Entries made on the checks or individual transaction forms are thereby automatically duplicated on the appropriate lines and columns on the underlying ledger or summary sheets. These systems are typically known as "one write" systems, since an entry need be written only one time and will appear on both the check and the ledger or summary sheet. Posting boards for "one write" systems of this type are illustrated, for example, in U.S. Pat. Nos. 4,429,902 and 4,687,229, assigned to the same assignee as the present invention.

Prior posting boards typically have a series of locating pins along one edge of a flat writing surface. The "one write" forms, i.e., the underlying forms and the check stubs, are aligned by placing the perforations in the forms and the perforations in the check stubs over the pins. A means of retaining the forms and checks, and securing them in place, is usually provided.

These prior posting boards are fine for use at a desk, table or counter, but can be bulky and unwieldy to carry in a briefcase, and are difficult to use in a confined space such as an automobile or while sitting in a train or airplane seat. However, it is often necessary to carry a posting board or the like from an office environment into the field. There is therefore a need for a small, easily portable writing apparatus that enables a user to take "one write" forms along when he or she leaves the office, and write checks or other transactions and post them to a ledger or summary sheet while traveling. The present invention is such an apparatus.

SUMMARY OF THE INVENTION

The present invention is a portable writing apparatus comprising a substantially flat writing surface and a plurality of post means which are adjacent to one edge of the writing surface and extend outwardly therefrom. At least one of these post means is formed with a recess therein.

The apparatus further comprises latch cover means. The latch cover means, which is designed to overlay the plurality of post means, has a plurality of openings therein. These openings are designed to receive the plurality of post means when the latch cover means is laid thereover.

Integral with the latch cover means is a latch means which is itself associated with at least one of the openings in the latch cover means. This latch means releasably attaches the latch cover means to the post means which has a recess therein.

These and other features, aspects and advantages of the present invention will become apparent to those skilled in the art upon reading the following detailed description.

DESCRIPTION OF THE DRAWINGS

For the purpose of illustrating the invention, there is shown in the drawings a form which is presently preferred. It is understood, however, that this invention is not limited to the precise arrangements and instrumentalities shown therein.

DESCRIPTION OF THE INVENTION

Figure 1:
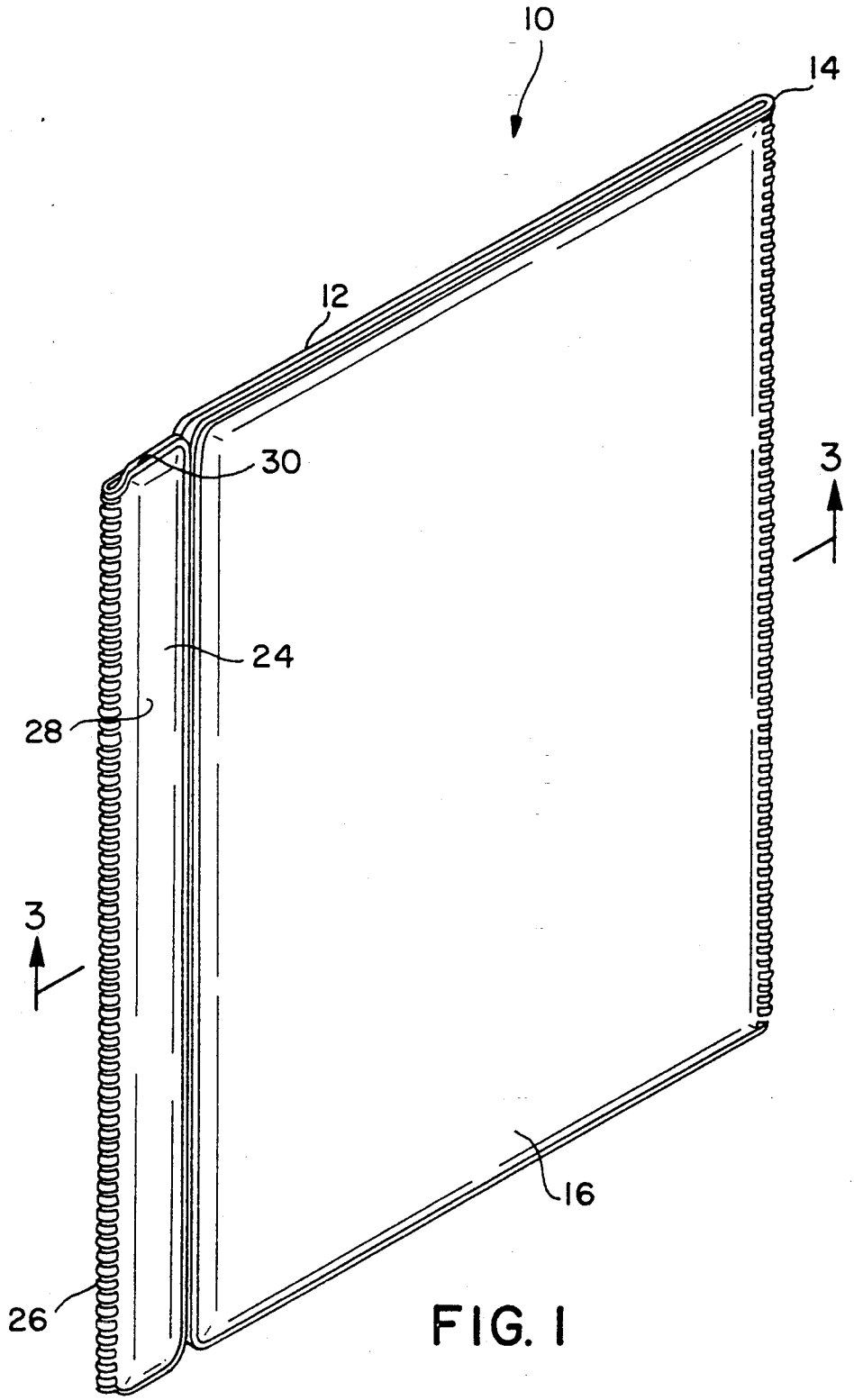
FIG. 1 is an isometric view of a portable writing apparatus according to the present invention.

Referring now to the drawings, wherein like numerals indicate like elements, there is shown in the figures one embodiment of a portable writing apparatus 10 according to the present invention. Apparatus 10 comprises a generally flat writing surface 12. Writing surface 12 may be any suitable material, such as aluminum or other metal, but is preferably a PVC blended plastic. A PVC blended plastic is preferable to metal and offers cost and weight advantages over metal surfaces such as aluminum.

Preferably, although not necessarily, writing surface 12 has a hinge means 14 therein which divides writing surface 12 approximately in half, so that writing surface 12 may be folded back onto itself to form a document cover 16. Hinge means 14 may, but need not, be made integral with writing surface 12.

Adjacent one edge of writing surface 12 are a plurality of post means 18 which extend outwardly a short distance from writing surface 12. Post means 18 are preferably, although not necessarily, in the shape of a right cylinder and therefore have a circular cross-section. As those familiar with "one write" document systems will understand, these post means serve to locate and align the "one write" documents 20 which are intended to be used with apparatus 10. Thus, documents 20 have a corresponding plurality of circular perforations 22 which receive post means 18.

Latch cover means 24 secures documents 20 in apparatus 10. Preferably, although not necessary, latch cover means is hingedly attached to the writing surface 12 at the edge of the writing surface adjacent to that which the post means 18 are arranged. Preferably, although not necessarily, a hinge means 26 is formed integrally with latch cover means 24 and writing surface 12.

Figure 2:
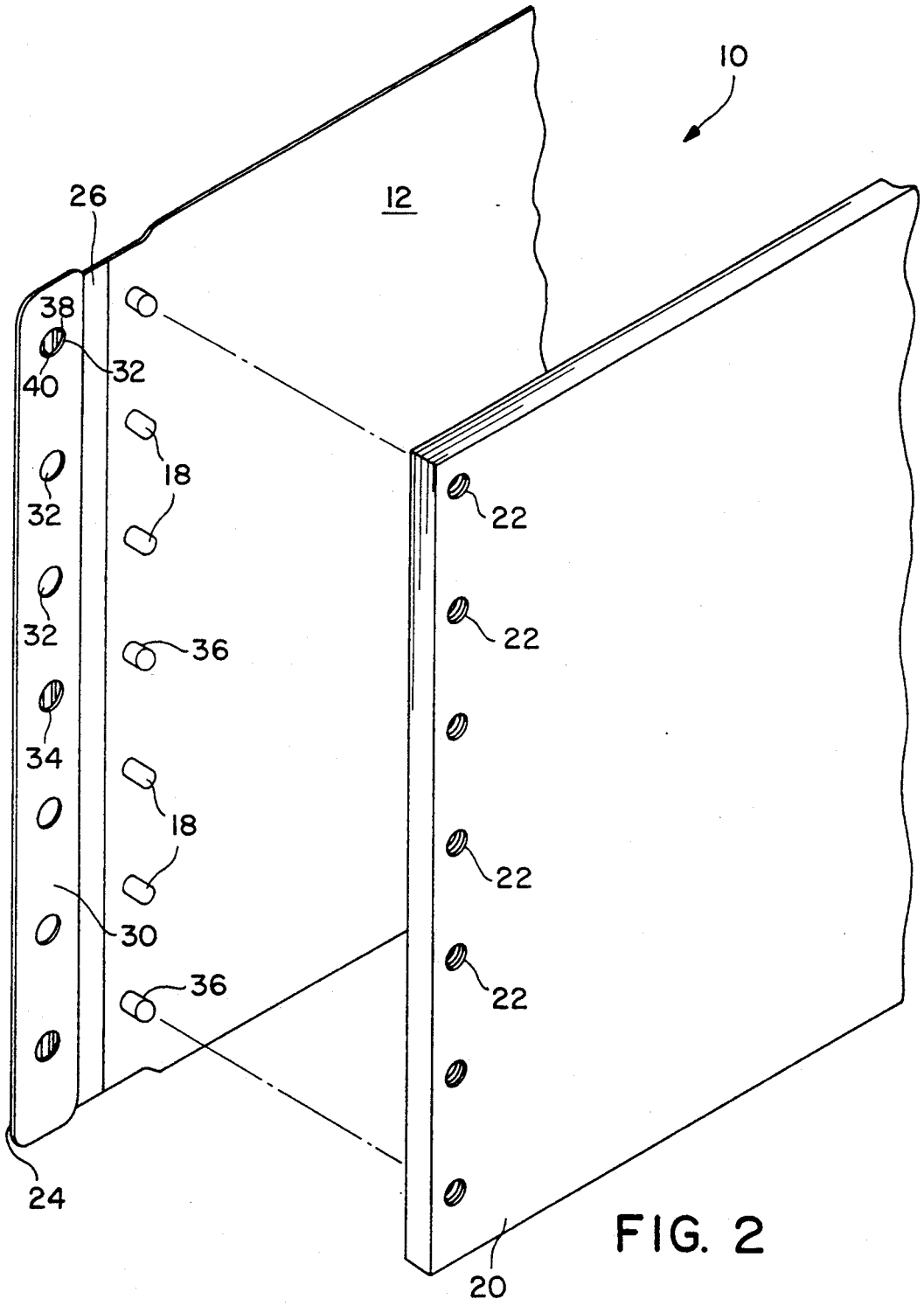
FIG. 2 is a partially broken-away view of the apparatus shown in FIG. 1, showing insertion of "one write" forms into the apparatus.
Figure 3:
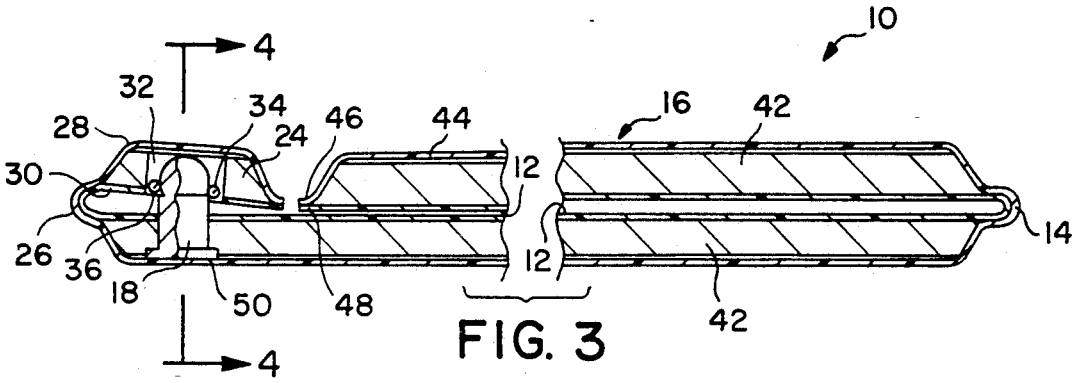
FIG. 3 is a sectional view of the apparatus of FIG. 1, taken along the lines 3—3 of FIG. 1.

In the preferred embodiment wherein latch cover means 24 is hingedly attached to writing surface 12, latch cover 24 has at least an open position, shown in FIG. 2, and a closed position, shown in the remaining figures. The open position of latch cover means facilitates the insertion of documents 20. When in the closed position, latch cover means 24 secures documents 20 in apparatus 10.

Latch cover means 24 has an outer surface 28 and an inner surface 30. A plurality of openings 32, which are preferably but not necessarily circular, are provided on inner surface 30, and are arranged to be in registry with and to receive post means 18 when the latch cover means 24 is laid thereover. The openings 32 do not extend through to the outer surface 28.

Latch cover means 24 is releasably retained in the closed position by at least one, and preferably two or more, latch means 34. Latch means 34 cooperates with a recess 36 in a corresponding one or more post means. As best seen in FIG. 2, latch springs are embedded in latch cover means 24. Preferably, although not necessary, latch means 34 is in the form of parallel spring wire members 38 and 40 which are associated with at least one of openings 32 and are disposed so as to lie along chords of the circular openings. The spacing between wire members 38 and 40 is less than the diameter of post means 18, and, preferably, slightly less than the diameter of the recess 36. Thus, when latch cover means 24 is moved into its closed position, spring wire members 38 and 40 contact the free end of a recessed post means and are urged apart. As latch cover means 24 is urged into the fully-closed position, spring wire members 38 and 40 enter recess 36.

In the preferred embodiment wherein the spacing between spring wire members 38 and 40 is slightly less than the diameter of recess 36, members 38 and 40 lightly, yet releasably, grip the recessed post means. Accordingly, latch cover 24 can be disengaged from the recessed post means such that documents 20 may be removed or inserted.

By thermally embedding the ends of spring wire members 38 and 40 in latch cover means 24, the need for an insert mold is eliminated, leading to considerable cost savings from both a capital outlay and a per piece perspective.

Apparatus 10 may be constructed of any suitable materials without departing from the present invention. As already indicated, writing surface 12 may be of any suitable material, although it is preferred that writing surface 12 be a lightweight material such as PVC blended plastic. To reduce weight, writing surface 12 is preferably made very thin and then bonded, either by an adhesive or thermally, to one surface of a supporting core 42, which is preferably a rigid plastic. The opposite surface of supporting core 42 is covered by a covering layer 44, which is preferably made of vinyl, leatherette or similar material. Covering layer 44 is joined at its periphery 46 to the periphery 48 of writing surface 12 in suitable fashion, such as, for example, by thermal bonding.

In the case where the writing surface 12 is divided into two parts, as already illustrated and described, hinge 14 may be formed by bonding a portion of covering layer 44 directly to writing surface 12 along a line generally transverse of writing surface 12. Writing surface 12 and covering layer 44 are preferably thin enough so as to be easily flexed. To give hinge 14 added strength and longevity, a cloth layer (not shown in the drawings) can be bonded in between writing surface 12 and covering layer 44. Such a construction gives hinge 14 an estimated useful life as much as two-and-a-half times that of a conventional bonded layer hinge, which tends to break after repeated flexing. Of course, if present, hinge 26 may be constructed in the same manner as hinge 14.

Figure 4:
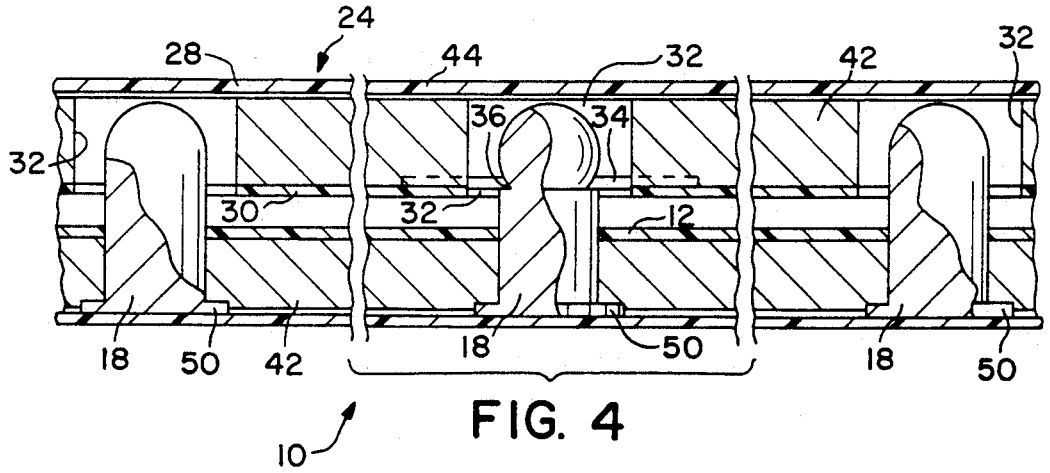
FIG. 4 is a sectional view of the apparatus, partially broken away, taken along the lines 4—4 of FIG. 3.

As shown in FIG. 4, post means 18 may be anchored within core 42, and may be held in place by a suitable adhesive, thermal bonding, or other suitable means. If desired, post means 18 may be provided with a peripheral flange 50 at one end to better secure post means 50 in core 42 and to resist pull-out. For safety, the end 52 of post means 18 opposite flange 50 is preferably rounded, so that there are no sharp edges that could injure a user.

The present invention may be embodied in other specific forms without departing from the spirit or essential attributes thereof and, accordingly, reference should be made to the appended claims, rather than to the foregoing specification, as indicating the scope of the invention.

I claim:

1. A portable writing apparatus comprising:

(a) a substantially flat writing surface, (b) a plurality of post means adjacent one edge of the writing surface and extending outwardly therefrom, at least one of said post means being formed with a recess therein, (c) latch cover means designed to overlay said plurality of post means, said latch cover means defining a plurality of openings therein for receiving said plurality of post means when said latch cover means is laid thereover, and (d) latch means embedded in said latch cover means for releasably attaching said latch cover means to said post means having a recess therein, said latch means being integral with said latch cover means and being associated with at least one of said openings in said latch cover means.

2. A portable writing apparatus comprising:

(a) a substantially flat writing surface, (b) a plurality of post means adjacent one edge of the writing surface and extending outwardly therefrom, at least one of said post means being formed with a recess therein, (c) latch cover means designed to overlay said plurality of post means, said latch cover means defining a plurality of openings therein for receiving said plurality of post means when said latch cover means is laid thereover, (d) latch cover hinge means integral with the one edge of the writing surface and the latch cover means for attaching the latch cover means to the writing surface, and (e) latch means for releasably attaching said latch cover means to said post means having a recess therein, said latch means being integral with said latch cover means and being associated with at least one of said openings in said latch cover means.

3. A portable writing apparatus as in claim 2, wherein said writing surface comprises two portions joined by a writing surface hinge means.

4. A portable writing apparatus as in claim 3, wherein said writing surface hinge means is integral with said two portions.

5. A portable writing apparatus as in claim 3, wherein said two portions are substantially equal in size.

6. A portable writing apparatus as in claim 5, wherein said writing surface is coextensive with said two portions and wherein one of said portions may be folded along said writing surface hinge means to substantially overlie the other of said portions.

7. A portable writing apparatus as in claim 2, wherein the plurality of openings extend only partially through the latch cover means.

8. A portable writing apparatus comprising:

(a) a substantially flat writing surface, (b) a plurality of post means adjacent one edge of the writing surface and extending outwardly therefrom, at least one of said post means being formed with a recess therein, (c) latch cover means designed to overlay said plurality of post means, said latch cover means defining a plurality of openings therein for receiving said plurality of post means when said latch cover means is laid thereover, and (d) latch means for releasably attaching said latch cover means to said post means having a pair of opposed wire spring members for receiving said recess in said post means therebetween, said latch means being integral with said latch cover means and being associated with at least one of said openings in said latch cover means.

9. A portable writing apparatus as in claim 8, wherein the space between said pair of opposed wire spring members is less than the diameter said post means.

10. A portable writing apparatus as in claim 8, wherein said latch means is embedded in said latch cover means.

11. A portable writing apparatus comprising:

(a) a substantially flat writing surface, said writing surface comprising two portions substantially equal in size and joined by a writing surface hinge means which is integral with said two portions, and said writing surface being coextensive with said two portions such that one of said portions may be folded along said writing surface hinge means to substantially overlie the other of said portions, (b) a plurality of post means adjacent one edge of the writing surface and extending outwardly therefrom, at least one of said post means being formed with a recess therein, (c) latch cover means integrally hinged by a latch cover hinge means to said one edge of said writing surface, the latch cover means having a closed position in which the latch cover means overlies the plurality of post means, said latch cover means defining a plurality of openings therein for receiving said plurality of post means when said latch cover means is in said closed position, and (d) latch means comprising a pair of opposed wire spring members embedded in said latch cover means and associated with at least one of said openings in said latch cover means for releasably receiving therebetween said recess in said post means.

* * * * *